United States Patent [19]

Jackson et al.

[11] 4,336,429

[45] Jun. 22, 1982

[54] SWITCH UNIT

[75] Inventors: Thomas M. Jackson, Bishops Stortford; Robert J. Hodges, Cheshunt; Stephen L. Amphlett, Bishops Stortford, all of England

[73] Assignee: ITT Industries, Inc., New York, N.Y.

[21] Appl. No.: 196,622

[22] Filed: Oct. 14, 1980

[30] Foreign Application Priority Data

Oct. 16, 1979 [GB] United Kingdom ..... 7935896

[51] Int. Cl.[3] ..... H01H 5/18

[52] U.S. Cl. ..... 200/67 DB; 200/283; 200/339

[58] Field of Search ..... 200/67 DB, 159 A, 283, 200/339

[56] References Cited

U.S. PATENT DOCUMENTS

| | | | |
|---|---|---|---|
| 1,215,665 | 2/1917 | Landis | 200/67 DB |
| 2,444,529 | 7/1948 | Puster | 200/67 DB |
| 2,523,786 | 9/1950 | Soreng | 200/69 |
| 2,755,352 | 7/1956 | Birkemeler | 200/67 DB |
| 2,923,787 | 2/1960 | Nelson | 200/67 DB |
| 3,582,584 | 6/1971 | Best | 200/67 DB |
| 4,191,867 | 3/1980 | Feaster | 200/153 LA |

*Primary Examiner*—John W. Shepperd

*Attorney, Agent, or Firm*—James B. Raden; William J. Michals

[57] ABSTRACT

A snap-action switch unit uses as its movable element a spring strip (23) mounted in a frame (20) such that the strip is bowed. A rod or the like (22) across the strip at its middle constrains the strip so that one half is bowed away from a flat surface (21) while the other half is adjacent to and roughly parallel with the flat surface.

On the opposite side of the spring strip (23) to the flat surface (21) there is a rocker (28) depression of which flips the spring strip (23) between two stable states. Integral with the strip (23) there are contact-bearing tongues (26, 27) which co-operate with stationary contacts on the supporting surface (21).

Alternatively the spring strip carries a transverse strip carrying two contact buttons which co-operate with stationary contacts.

1 Claim, 5 Drawing Figures

SWITCH UNIT

This invention relates to electrical snap-action switches, especially for use in automotive, industrial and consumer products.

For such applications, switches are needed which are cheap and easy to manufacture, and which are rapid and positive in operation. One switch which has been designed to satisfy the requirements for such applications has been described in our application No. 18969/78 (T. M. Jackson—R. J. Hodges 60-37).

In the abovementioned application we have claimed an electrical snap-action switch, which includes a strip of a springy and electrically conductive material held captive in a frame such that the strip is bowed, a rod or the like extending across the frame at right angles to the length of the strip and located between the ends of the frame, a supporting surface adjacent to the strip and on the opposite side thereof from the rod or the like, which surface extends between the points of the frame at which the strip is held captive and is generally parallel to the length of the strip, the rod or the like bearing on the strip so as to constrain it into a position wherein the portion thereof between one end of the frame and the rod or the like is bowed away from the supporting surface while the portion thereof between the rod or the like and the other end of the frame lies along the supporting surface, an operating element adjacent to the strip and on the opposite side thereof from the supporting surface, which element when operated depresses the bowed portion of the strip to cause that strip to snap to a position wherein its formerly bowed portion lies along the supporting surface while its other portion is bowed away from the surface, the rod or the like thus providing a guide for the strip, and contact means so located on the supporting surface as to co-operate with the spring strip in at least one of its operated and its non-operated positions.

Although such a switch is satisfactory in many applications, it has the disadvantage that contacts actually attached to the switch by, for instance, welding, detrimentally affect switch action. Hence it is an object of the present invention to provide a switch of the abovementioned type in which the above disadvantage is minimised or even eliminated.

Hence in accordance with the present invention there is provided an electrical snap-action switch, which includes a strip of a springy material held captive in a frame such that the strip is bowed, a rod or the like extending across the frame at right-angles to the length of the strip and located between the ends of the frame, a supporting surface adjacent to the strip and on the opposite side thereof from the rod or the like, which surface extends between the points of the frame at which the strip is held captive and is generally parallel to the length of the strip, the rod or the like bearing on the strip so as to constrain it into a position wherein the portion thereof between one end of the frame and the rod or the like is bowed away from the supporting surface while the portion thereof between the rod or the like and the other end of the frame lies along the supporting surface, an operating element adjacent to the strip and on the opposite side thereof from the supporting surface, which element when operated depresses the bowed portion of the strip to cause that strip to snap to a position in which its bowed portion lies along the supporting surface while its other portion is bowed away from the surface, the rod or the like thus providing a guide for the strip, and contact means so located on the supporting surface as to co-operate with further contact means controlled by the movement of the springy strip between its non-operated and its operated positions, wherein said further contact means is carried by a portion of material controlled by the springy strip but separate from or additional to the bowed portion of the springy strip.

Embodiments of the invention will now be described with reference to the accompanying drawings, in which FIG. 1 is a schematic representation of the basic switch module of the abovementioned application.

FIGS. 2*a* and 2*b* show two variants of a first method embodying the invention of attaching contacts to the spring strip of a switch such as that of FIG. 1.

FIG. 3*a* to 3*f* show six variants of a second method embodying the invention of attaching contacts to the spring strip of a switch such as that of FIG. 1.

Figure 1:
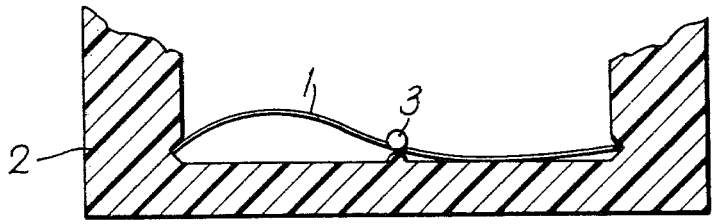

The electrical switch module to be described is, like that of the above-mentioned patent application based on the buckling action of a captive length of spring material. As will be seen from FIG. 1, the spring strip 1 is restrained in a housing 2 which is marginally shorter than the strip 1, and is also restrained at its centre by a rod or the like 3 so that it assumes a buckled condition as shown in FIG. 1. This strip, as shown in FIG. 1 has its portion between the rod 3 and the left-hand end of the frame bowed outwardly from the frame, and its portion between the rod and the right-hand end of the frame lying along, adjacent to, and roughly parallel with the surface of the supporting frame.

The characteristics of the switch are such that if the bowed portion of the spring strip is pressed, a point of instability is reached at which the strip flips or snaps under the rod or the like 3 to its alternative stable position. In this alternative position the portion shown bowed in FIG. 1 lies along, roughly parallel to, and adjacent to the surface of the frame 2, while the other portion is then bowed away from the frame. Thus, due to the profile of the frame base and the position of the restraining rod or the like relative to the end restraining points, before snap action occurs all strip distortion is on the left-hand or activation side. This is achieved as the base profile is parallel to, but slightly lower than, an imaginary line joining the end restraining points and the central restraining point. This is important as it gives such a switch its distinctive and desirable snap action.

To function as a switch the strip has to carry, or act as, a contact, and in the abovementioned application the strip itself acts as a contact, in which case the choice of material is limited to metals having good electrical conductivity. Where contacts are carried by the strip it is important to ensure that the method of mounting the contacts does not interfere with the snap action of the switch. For this reason contacts welded to the strip are not desirable as they detrimentally affect the switch action. Further, contacts so attached may in some cases break slowly before the strip snaps over, an undesirable phenomenon known as teasing.

The techniques provided by the present invention overcome the above problems.

In the first of these techniques a pair of contacts are mounted on a carrying strip of conductive (but not necessarily springy) metal strip, such as phosphor bronze or beryllium copper. Thus in FIG. 2 we have a strip 5 which carries two contacts 6, the strip 5 being attached to the switch strip, 1, FIG. 1, so that its length is at right angles to the length of the switch strip. This attachment is not rigid, and by reason of the degree of looseness thus provided it does not interfere with the basic switch action.

In the arrangement of FIG. 2*a* the strip 5 is rather bracelet-like in that its ends are bent over the edge of the spring, strip location being by recesses or cut-outs in the edges of the spring strip. The location of the bent over portions could also be effected by grooves or holes in the spring strip. In the arrangement of FIG. 2*b* the ends of the strip 5 each extends through a hole in the spring strip, but is not bent over inwards.

Figure 2:
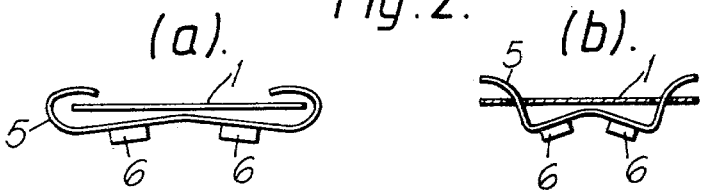

With the arrangements of FIG. 2, each of the movable contact arrangements acts as a bridging contact to co-operate with two contacts in the base of the switch, and any teasing due to the contacts or the spring strip guides being out of parallel is eliminated by rotation of the strip 5 about its central point.

A switch using arrangements such as those of FIG. 2 can be used as a single make or single break switch, or if two strips such as 5 are provided, one on each side of the rod or the like 3, as a changeover.

The material used in these arrangements for the spring strip 1 is one which gives the best mechanical properties, e.g. extra hard rolled stainless steel, or tempered and hardened high carbon steel strip.

Figure 3:
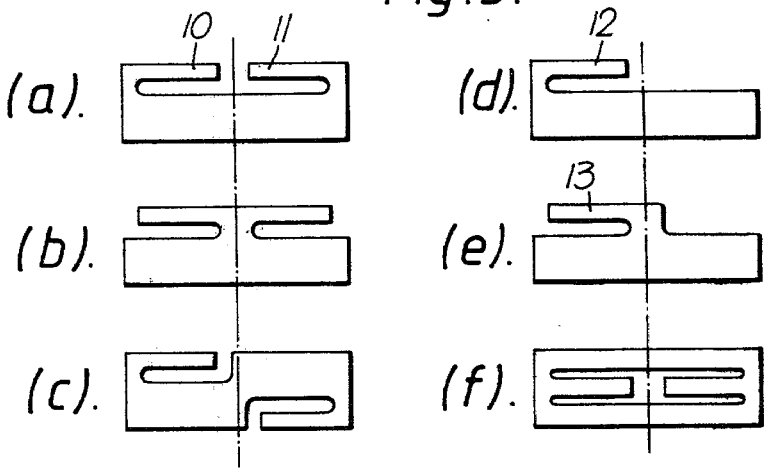

In the second technique provided by the present invention, a cut-out or cut-outs is/are introduced into the spring strip, and examples of such cut-outs are shown in FIG. 3, where in all cases the central dashed line indicates the pivot line due to the rod or the like 3, FIG. 1. In all the cases shown in FIG. 3, the ends of the strip are captivated, as for the switch shown in FIG. 1. Thus the spring strip now comprises two (or three) sections, one of which controls the mechanical characteristics while the other (or others) the electrical characteristics. As will be seen later each of the tongues such as 10, 11 provided for the electrical function can carry a small plug of a contact-making material.

In its simplest form, e.g. as in FIG. 3(*d*) or FIG. 3(*e*) the switch acts as a single make or break, with one contact at an end of a strip such as 12, 13, which co-operates with a stationary contact in the switch base. In such case reliable contact is assured by the rubbing action of the contact making portion of the strip during operation. Note that with an arrangement such as FIG. 3(*a*), FIG. 3(*b*), FIG. 3(*c*) or FIG. 3(*f*), in which there are two such tongues to the strip, by provision of two basal contacts we can obtain a change-over contact unit.

Dependent on the current and voltage values to be handled, and whether the switch is intended to switch AC or DC, the mating contact faces may be bare strip surfaces, plated surfaces, or discrete contacts attached to the tongue, e.g. by welding.

Figure 4:
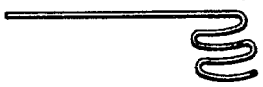
FIG. 4 shows schematically a modification to any one of the variants of FIG. 3.

An increase in material volume at the contact point of the tongue, which may be desirable can be achieved in a number of ways, one of which is shown in FIG. 4, where the end of the tongue is bent over on itself. Another way is to use a profiled strip in which the contact tongue is made of thicker material than the mechanical section. Such an increase in material volume is beneficial in two respects. Firstly it increases the material available for arc erosion, which is inevitable when switching medium range direct currents, thus lengthening the life of the device. Secondly, increase in volume helps to increase contact pressure by virtue of its effect on mass and stiffness.

Another way to increase contact pressure beyond that due to the mechanical characteristics of the strip is to include some form of spring member in the switch's operating element, which would apply additional pressure to the contact arm with the switch in its "on" position.

Variations in switch design are possible: thus as can be seen from FIG. 3, contact tongues may be formed on both ends of the strip to give a switch with change-over capability. Again, strips may be arranged adjacent to one another to form a double or multi-pole switch operated by a single operating member. Finally, two strips may be stacked one above the other and separated by an insulating layer to give a double pole capability.

Strip material for the arrangements shown in FIG. 3 or 4 have to provide for adequate electrical as well as mechanical properties. Hence stainless steel is not suitable because of its high resistivity, so a copper alloy such as beryllium copper or phosphor bronze is used. The switch characteristics can be modified to meet specific operating requirements and power-handling capability by appropriate selection of strip thickness, width and length, the length relative to the housing, and the point of actuation.

Figure 5:
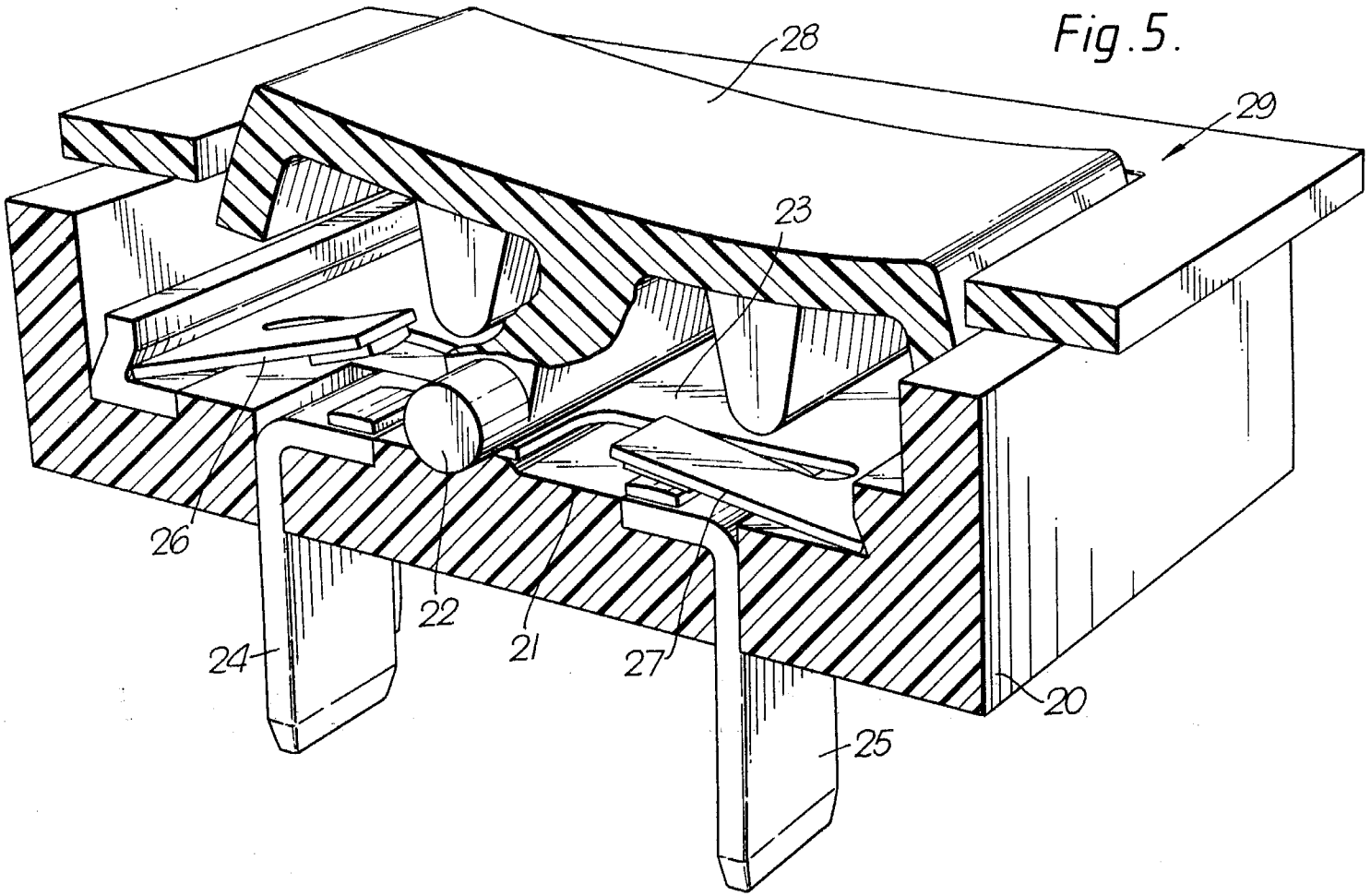
FIG. 5 shows in partially cut-away form and somewhat enlarged a switch using the arrangement of FIG. 3*a*.

The switch module is suitable for most types of operating members, e.g. rocker, push-button and slide, and FIG. 5 shows a switch with an arrangement as in FIG. 3(*a*), and with rocker activation. The switch has a main body portion 20, which is about 2" to 2½" long having a flat surface 21 with a raised portion at the middle aligned with the "guide" rod 22. This latter rod bears on the central region of a spring strip 23 of, for instance, beryllium copper. Let into the surface 21 there are two contacts 24, 25, each with a precious metal contact button, as shown.

The spring strip has two flat tongues 26, 27 each with a contact button, so located as to co-operate with the contact buttons of the contacts 24 and 25 respectively. On the opposite side of the spring strip 23 from the surface 21, there is a rocker 28, which as shown is integral with the rod 22. This is held in place by a closure plate 29. The member 20, rocker 28 and plate 29 are all of a suitable plastics material.

Operation of the rocker 28 controls the switch in the manner described above.

Note that, dependent on the characteristics of the operating element such as the rocker 28, the switch can be arranged to be bistable or monostable.

Variations in switch design are possible. Contact arms may be formed on both ends of the strip to give a switch with a change-over capability. Strips may be arranged adjacent to one another to form a double or multipole switch operated by a single toggle. Two strips may be stacked one on top of the other, separated by an insulating layer to give a double pole capability.

Strip material for this second decoupled solution would have to provide for adequate electrical properties as well as mechanical properties. Due to its high resistivity, stainless steel is not suitable on its own and so a copper alloy such as beryllium copper or phosphor bronze would be used. Alternatively, if the mechanical characteristics of a material like stainless steel is considered especially desirable, it could be used, with copper plating to improve conductivity.

The characteristics of the switch can be modified to meet specific operating requirements and power handling capability by the appropriate selection of strip thickness, width and length, the strip length relative to the housing and the point of actuation.

Reverting to FIG. 3, and especially to FIG. 3(*d*), it should be noted that the contact-carrying arm 12 may extend beyond the centre line if this is desirable for operational reasons. One example in which this is so is where the switch handles "mains" alternating current: to meet British and European standards a 3 mm-gap between the open contacts is needed. This is conveniently achieved by the use of the lengthened arm 12.

Variations in the operating arrangements for the switch have been mentioned above: some of these will now be considered in slightly greater detail. The centrally-pivoted rocker shown in FIG. 5 could be, in effect, an arm formed integral with the rod (as in FIG. 5), but with a push-button at each end. Such a rocker arm plus push-buttons can then be held in place in the switch frame by a cross-arm parallel to the pivot arm (22 in FIG. 5).

Another possibility is to have two separate push-buttons one on each side of a central member whose upper-face is parallel with the upper face of the switch frame. This central member carries, or is integral with the pivot rod. The push-buttons thus provided could each be supported by a further pivot on the switch frame. Another way to operate the push-buttons uses a rotable knob having on its inner face a sloped portion which when suitably placed depresses one or other of the push-buttons.

In the case of slide-operated devices, very popular for switches used in "automotive" applications, the slide in one case has on each side of its centre portion a bevelled member which performs the depression of the spring strip needed to cause switching.

We claim:

1. An electrical snap-action switch, which includes a strip of a springy material held captive in a frame such that the strip is bowed, a rod extending across the frame at right-angles to the length of the strip and located between the ends of the frame, a supporting surface adjacent to the strip and on the opposite side thereof from the rod, which surface extends between the points of the frame at which the strip is held captive and is generally parallel to the length of the strip, the rod bearing on the strip so as to constrain it into a position wherein the portion thereof between one end of the frame and the rod is bowed away from the supporting surface while the portion thereof between the rod and the other end of the frame lies along a substantial portion of the supporting surface, an operating element adjacent to the strip and on the opposite side thereof from the supporting surface, which element when operated depresses the bowed portion of the strip to cause that strip to snap to a position in which its bowed portion lies along the supporting surface while its other portion is bowed away from the surface, the rod thus providing a pivot for the strip, and contact means so located on the supporting surface as the co-operate with further contact means controlled by the movement of the springy strip between its non-operated and its operated positions, wherein said further contact means is carried by a portion of material controlled by the springy strip but separate from or additional to the bowed portion of the springy strip and wherein said further contact means in response to said operating element is alternately bowed away from the supporting surface or lies along the supporting surface.

* * * * *